114-242 SR
6/21/77 OR 4,030,441

United States Patent [19]
Nagata et al.
[11] 4,030,441
[45] June 21, 1977

[54] DEVICE FOR CONNECTING TUGBOAT WITH SHIP TO BE TUGGED

[75] Inventors: Toshio Nagata, Tokyo; Kunijiro Kawasaki, Sasebo; Ryuichiro Takahama, Sasebo; Yoshifusa Miyatani, Sasebo; Sozo Funakoshi, Sasebo, all of Japan

[73] Assignees: Kohan Sendan Kikai Kabushiki Kaisha; Sasebo Jukogyo Kabushiki Kaisha; Nishi Nippon Harbor Service Kabushiki Kaisha, all of Japan

[22] Filed: Nov. 17, 1975

[21] Appl. No.: 632,275

[30] Foreign Application Priority Data

Mar. 18, 1975 Japan ..... 50-31852

[52] U.S. Cl. ..... 114/242; 294/65.5; 335/289

[51] Int. Cl.[2] ..... B63B 21/56

[58] Field of Search ..... 114/235 R, 235 A, 230; 335/289, 291; 294/65.5; 212/9

[56] References Cited

UNITED STATES PATENTS

| | | | |
|---|---|---|---|
| 621,267 | 3/1899 | Monell | 294/65.5 |
| 2,825,011 | 2/1958 | Injeski, Jr. | 335/291 |
| 3,443,698 | 5/1969 | Lopez | 212/9 |
| 3,968,986 | 7/1976 | Nagata | 335/289 X |

FOREIGN PATENTS OR APPLICATIONS

| | | | |
|---|---|---|---|
| 1,580,863 | 9/1969 | France | 114/230 |

*Primary Examiner*—Trygve M. Blix
*Assistant Examiner*—Sherman D. Basinger
*Attorney, Agent, or Firm*—Kane, Dalsimer, Kane, Sullivan and Kurucz

[57] ABSTRACT

An electromagnet is secured to one end of a tug rope which is to be paid out from a tugboat towards a ship to be tugged, and the electromagnet consists of a plurality of relatively movable magnetic pole members, and hence the whole magnetic pole surface of the electromagnet is composed of a plurality of magnetic pole surfaces of said magnetic pole members. Thus, the end surfaces of said magnetic pole members may accommodate themselves to the curved surface or non-irregular surface of the hull of a ship to be tugged due to the relative, independent movements of the respective magnetic pole members, thereby bringing each of the end surfaces of the magnetic pole members into intimate contact therewith, whereby the end of the tug rope may be rigidly secured to the hull of the ship by means of the electromagnet thus facilitating connection of the tugboat with the ship to be tugged, in positive, safe and simple manner.

2 Claims, 5 Drawing Figures

DEVICE FOR CONNECTING TUGBOAT WITH SHIP TO BE TUGGED

This invention relates generally to an accessory of a tugboat for use in tugging a ship, and more particularly to a device for connecting the tugboat with a ship to be tugged thereby, in which device a tug rope, one end of which is fastened to the tugboat, is equipped with an electromagnet at the other end thereof, thus providing a sophisticated joint means between the tugboat and the ship to be tugged.

In general, a tugboat and pushing boat are used for giving aid to the movement of a ship or its movements into or from a dock in the water basins of a loading and unloading harbor or a ship building yard.

Hitherto, the pushing boat has experienced no serious problem when pushing a ship for moving same, or moving same into or from a dock, while there are confronted by various problems, when tugging a ship by a tugboat. More particularly, a major problem in this is that a tugboat should be connected with a ship with a rope or wire. In general, it has been a common practice that one end of a rope or wire is fastened to a tugboat, while the other end of the rope which has been paid out, is received by operators, on the side of a ship, and then fastened to a suitable means on a deck. This requires several operators. Particularly in the case of a huge size ship, there results an extremely large difference in level between the ship and the tugboat so that there arise considerable difficulties and danger, in the rope receiving and fastening operations thus requiring many working hours and operators. In addition, the aforesaid extremely large difference in level between a ship and a tugboat leads to an increase in the elevation of the rope or wire, so that the thrust of the tugboat, i.e., the tugging force will be reduced to a great extent.

As can be seen from this, the connection of the tugboat with a ship by means of a rope or wire has been confronted with lack of speediness, safety and economy.

It is accordingly a principal object of the present invention to provide a device for connecting a tugboat with a ship to be tugged thereby, which device eliminates the aforesaid shortcomings experienced with the prior art and reduces the fastening operation of a tug rope to a ship, which rope has been paid out from a tugboat, while insuring positive and simple securing the end of the rope to the ship. In addition, the device according to the present invention permits the effective utilization of a thrust or a tugging force of the tugboat which is to be exerted on the ship to be tugged thereby.

According to the present invention, there is provided a device for connecting a tugboat with a ship to be tugged, which device includes a tug rope or wire, one end of which is secured to the tugboat, and the other end of which is equipped with an electromagnet, which consists of a plurality of magnetic pole members which are permitted the relative, independent movements.

According to another aspect of the present invention, there is provided a device which includes means for supporting said electromagnet in a movable manner on said tugboat, and means for moving said electromagnet towards the ship to be tugged by the tugboat.

Figure 1:
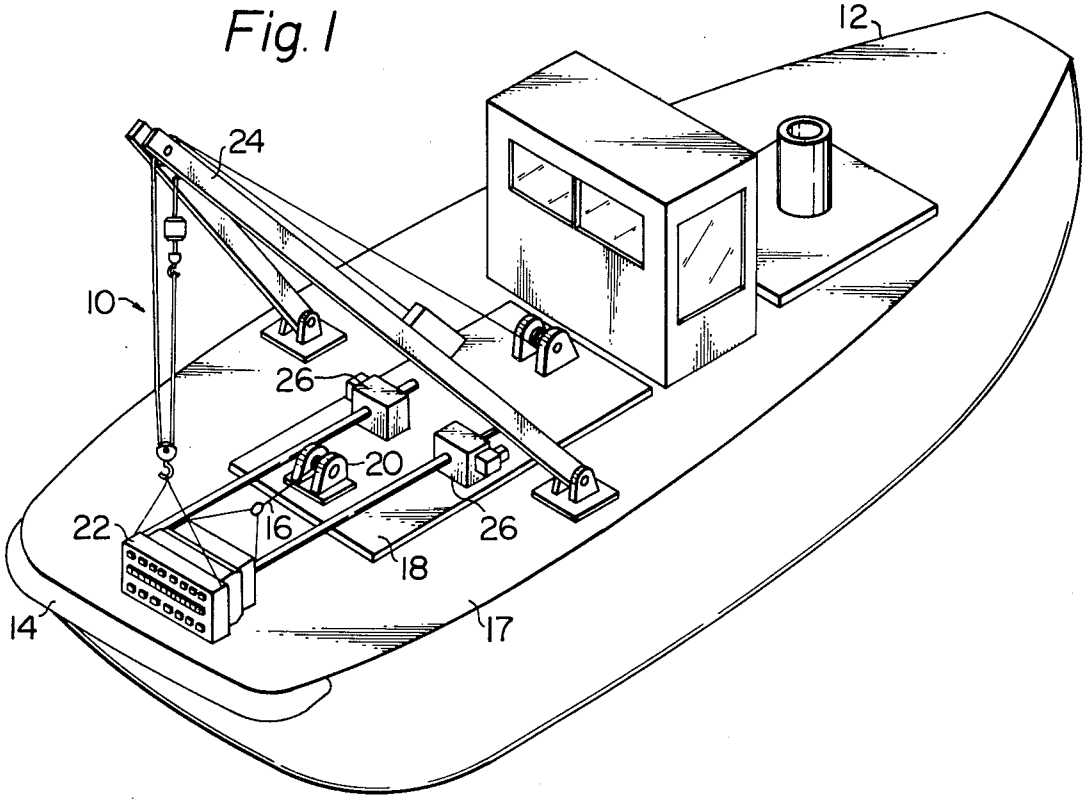
FIG. 1 is a perspective view of the outline of the tugboat provided with a device for connecting a tugboat with a ship to be tugged, according to the present invention.

Referring now to FIG. 1, there is shown a tugboat 12 equipped with a connecting device 10 which is mounted on a deck of the tugboat on the bow side thereof. The tugboat 12 is provided with a fender 14 made of a rubber-like resilient material or consisting of sand bags.

The connecting device 10 includes a tug rope 16, an anchor means 20 of an ordinary type, which is mounted on a base plate 18 located on a deck 17, for the purpose of securing one end of the rope to the tugboat 12 and an electromagnet adapted to secure the other end of rope to the hull of a ship to be tugged by the tugboat. In addition, the connecting device 10 includes a supporter 24 for supporting in a movable manner the electromagnet 22 which is connected to the other end of the tug rope 16 and a pair of pushers 26 adapted to move the electromagnet 22 from the tugboat rearwards or towards the ship to be tugged, or externally of the tugboat.

Figure 2:
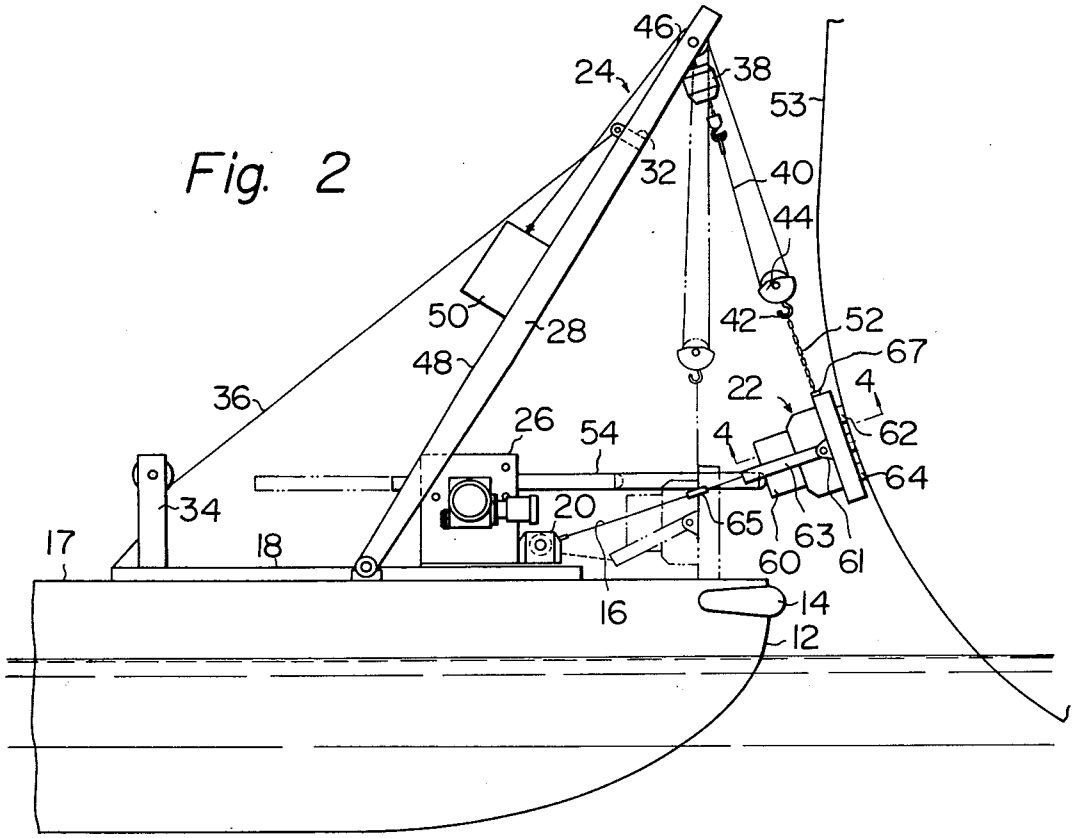
FIG. 2 is a side view of the device according to the present invention.
Figure 3:
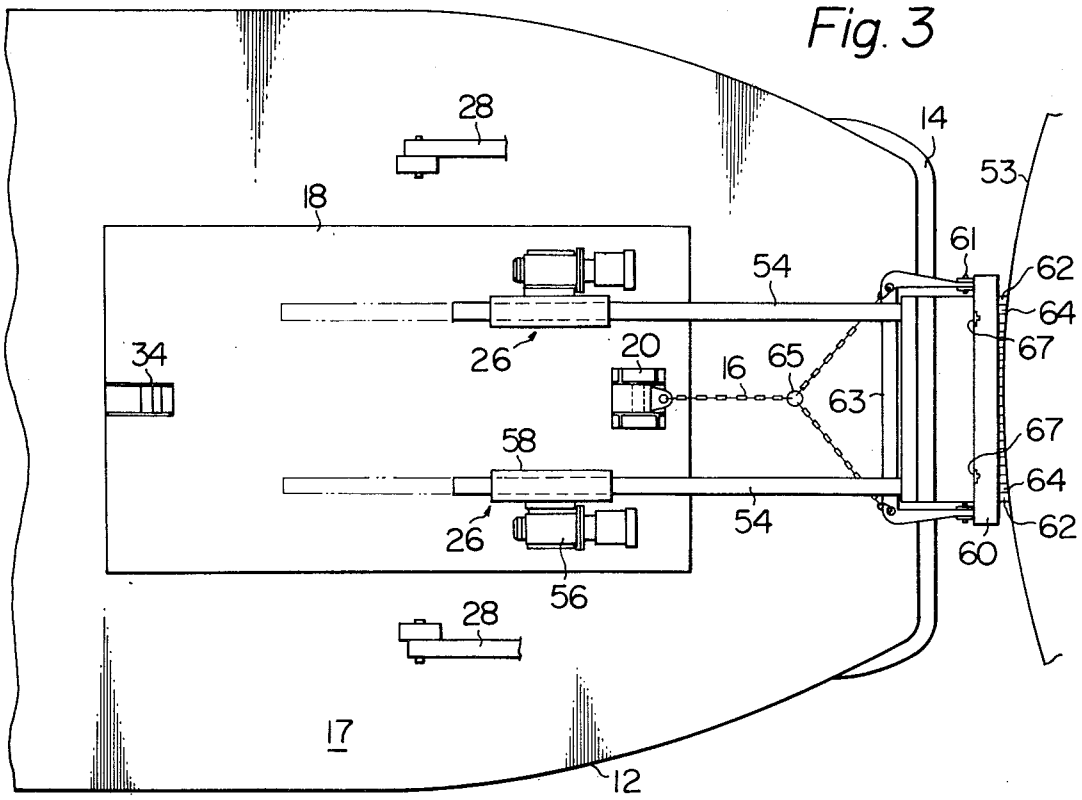
FIG. 3 is a plan view, partly broken, of the device according to the present invention.

Referring to FIGS. 2 and 3, said supporter 24 for the electromagnetic 22 is provided with a pair of posts 28 which are pivoted to the deck 17 at their lower ends, and a tension rope 36, one end of which is fastened to a fastening member 32 which is secured to the upper portion of the post 28 and the other end of which is fastened to an anchor member 34 mounted on the base plate 18. A chain block or preferably an electromotive chain block 38 is suspended from a supporting frame consisting of the posts 28 and the tension rope 36, while a wire 40 is trained around the chain block 38 at its one end. The wire 40 is trained around a movable pulley 44 having a hook 32, and then around a stationary pulley 46 provided on the top of a pair of posts 28, while the other end of the wire 40 is fastened to a counterweight 50, which is slidably placed on the upper surface 48 of the post 28. The weight of the counterweight 50 should be commensurate to the weight of the electromagnet device 22 connected to a hook of the movable pulley 44 by means of a chain 52. It is preferable that the counterweight as shown be arranged on the respective posts 28.

Normally, the electromagnet 22 is located in the position shown by a broken line in FIG. 2 on the deck 17, being connected with a chain block 38. A pair of pushers 26 are provided, having push rods 54 which are movable linearly in the axial direction of the tugboat 12, for the purpose of shifting the electromagnet 22 to the position where the electromagnet 22 contacts a hull 53 of the ship.

As shown in FIG. 3, the respective pushers 26 are provided with drive motors 56 having electromagnetic brakes (not shown), respectively, and the drive motors are so designed as to transmit a power required for the reciprocating movements of the rod 54 thereto by way of its drive shafts and pinions mounted thereon (not shown) which are placed within a casing 58 housing said pushing rods 54 therein, said rods 54 having racks (not shown) meshing with the aforesaid pinions.

The pushers 26 are actuated after the electromagnet 22 is lifted to some extent by means of the chain block 38, from the position shown by a broken line in FIG. 2. Thus, the tips of the pushing rods 54 engage the casing 60 of the electromagnet 22 to push same to the position shown by the solid line in FIG. 3. Conversely, when the electromagnet 22 is returned from the position shown by the solid line to the position shown by the broken line, the pushing rods are retracted, whereupon the electromagnet device 22 moves following the retracting movement of the pushing rods, to return onto the deck of the tugboat.

The electromagnet 22 which is connected with the tugboat 12 by means of the chain 16 serves to secure one end of the chain 16 to the hull 53 of the ship. The electromagnet 22 should be not only kept in contact with the hull 53 due to its magnetic force but also overcome the thrust of the tugboat 12 so as to be held on the hull rigidly. As is apparent from the foregoing, the electromagnet 22 which serves to secure one end of the tug rope, or chain 16 to the hull of the ship is the most outstanding feature of the present invention.

Figure 4:
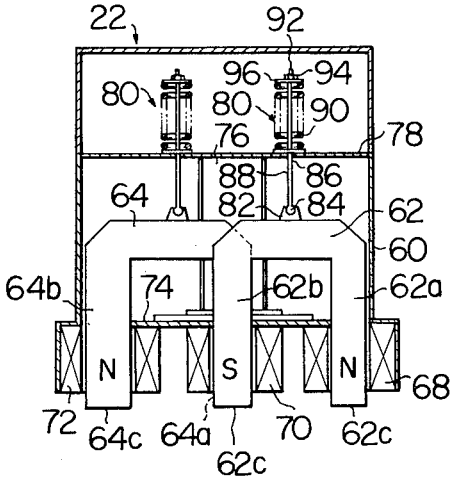
FIG. 4 is a partial elevational view of the electromagnet, part of which is shown in cross section, taken along the line 4—4 of FIG. 2.
Figure 5:
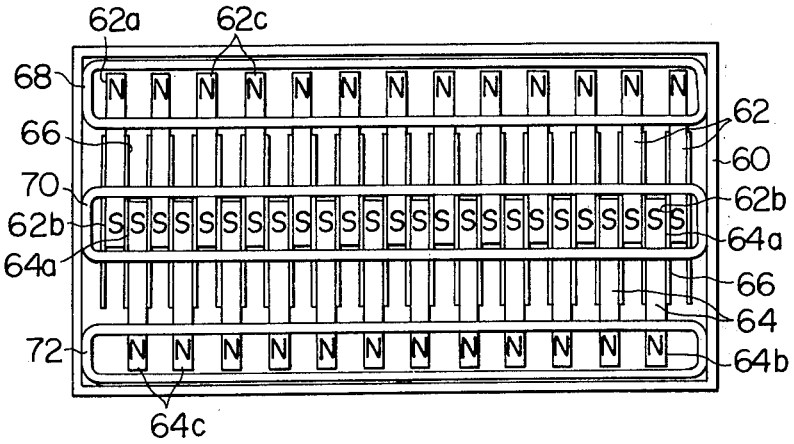
FIG. 5 is a bottom view of the electromagnet device shown in FIG. 4.

As shown in FIGS. 2 and 3, the electromagnet 22 is provided with a casing 60, to which an attaching member 63 is coupled. In addition, the tug rope 16 is secured to the attaching member 63 by the medium of a ring 65. On the other hand, an attaching portion 67 for the chain 52 is provided on the casing 60. As shown in FIGS. 4 and 5, a plurality of horse-shoe shaped or U shaped magnetic pole members 62, 64 which are made of ferromagnetic material are arranged in two rows within the casing 60. The magnetic pole members 62, 64 are formed with pairs of yokes 62*a*, 62*b* and 64*a*, 64*b* which oppose to each other, and with attracting surfaces 62*c*, 64*c*. In each row of the magnetic pole members 62, 64, said members are placed at a spacing as shown, while the yokes 62*b*, 64*a* on one side are placed alternately in a continuous manner. Disposed between the two magnetic pole members 62, 64 are spacers 66 made of non-ferromagnetic material.

On the other hand, provided within the casing 60 are a first exciting coil 68 which surrounds all of the yokes 62*a* on one side, of the magnetic pole members 62, a second exciting coil 70 which surrounds all of the yokes 62*b* on the other side of magnetic pole members 62, as well as all of the yokes 64*a* of the magnetic pole members 64, and a third exciting coil 72 which surrounds all of the yokes 64*b* on the other side, of the magnetic pole members 64. Those coils 68, 70, 72 are retained by means of the casing 60 and a plate member 74 located within the casing 60, and connected to an electric power source (not shown) equipped on the tugboat 12. The feeding of electric current to the respective coils magnetizes the yokes within the coil 68 to the same magnetic polarity, such as for instance, an N pole, while the yokes within the coil 70 are all magnetized to a S pole, and the yokes within the coil 72 are all magnetized to an N pole, so that a magnetic substance may be attracted to the magnetic pole surfaces 62*c*, 64*c*.

As shown in FIG. 4, the magnetic pole members 62, 64 are each provided within the casing and supported on a beam member 78 by means of a spring assembly 80, said beam member 78 being coupled to the plate member 74 by a plate member 76. The spring assembly 80 includes rod members 88, the ends of which are coupled to brackets 82 provided on top of the respective magnetic pole members by means of pins 84, and which extend through openings 86 defined in the beam member 78. Coil springs are provided around the rods 88 in concentric relation, respectively. The coil springs 90 are confined between the beam member 78 and spring seat members 96 which are secured on the rods 88 by means of nuts 94 threaded on said rods from their tips.

Since the magnetic pole members 62, 64 are pivoted to the spring assembly 80, respectively, as has been described earlier, the magnetic pole members 62, 64 may move relatively but independently of the adjoining magnetic pole members. It follows from this that the magnetic pole surfaces 62*c*, 64*c*, i.e., the attracting surfaces of the magnetic pole members 62, 64 may accommodate themselves to the surface of the hull of a ship in any position thereof, irrespective of whether the surface of the hull is curved or of an irregular shape, thus insuring positive contact of the magnetic pole surfaces of the members 62, 64 with the surface of the hull of the ship. As can be seen from this, the electromagnet 22 consisting of a plurality of magnetic pole members 62, 64 may provide an extremely increased contacting area to a curved or irregular surface of a magnetic substance, as compared with the electromagnet having a single flat magnetic pole surface having the same polarity. Thus, the electromagnet 22 may effectively exert a magnetic force on the skin 53 of the ship, which is of irregular shape.

The magnetic pole members may be arranged in a single row in side-by-side relation or at a certain spacing. Alternatively, the magnetic pole members may be arranged in no less than three rows, as desired.

When the tugboat 12 is connected with a ship to be tugged thereby, the electromagnet device 22 is first lifted from the position, shown by a broken line in FIG. 3, on the deck 17. The electromagnet device 22 is lifted to the level, on which the pushing rod 54 of the pushing device 26 may abut the electromagnet device 22. Thereafter, the pushing rod is directed towards the hull 53 of the ship, which is in access to the tugboat, by moving the tugboat, after which the pushing device 26 is operated so as to push the electromagnet device by means of the pushing rods 54. During the movement of the electromagnet device 22 towards the hull 53 of the ship, an electric current is fed to the coils 68, 70, 72 of the electromagnet 22 to excite all of the magnetic pole members 62, 64. When the magnetic pole members 62, 64 contact the side of the ship by means of the push rods 54, then the magnetic pole members 62, 64 independently move around the pins 84, while the coil springs 90 relatively move due to compression, so that the magnetic pole members 62, 64 are drawn to the hull 53 of the ship according to the magnetic force of the magnetic pole members 62, 64. The magnetic pole members are excited before they contact the hull 53 of the ship, so that the moment the respective magnetic pole members approach the hull of the ship at a distance to permit their magnetic forces to exert on the hull, the magnetic pole members dart at the hull surface. In this respect, the magnetic pole members effect the relative displacements to cope with the shape of the hull 53 of the ship as shown in FIGS. 2 and 3, so that each of the magnetic pole members may have its magnetic pole surface contact the hull of the ship, thus insuring positive but strong securing of the electromagnet device to the hull of the ship.

The securing of one end of the tug rope 16 to the hull of the ship in this manner permits the efficient achievement of the functions of the tugboat 12, i.e., tugging of the ship in a simple, safe and positive manner. Before the tugging of the tugboat, the pushing rods are retracted to their home positions.

Upon interrupting the connection of the tugboat 12 with the ship being tugged, the pushing rods 54 are advanced until they abut the electromagnet device 22, and then the magnetic pole members 62, 64 of the electromagnet 22 are demagnetized with their movements restricted by means of the push rods 54. The electromagnet device 22 which has been detached from the hull of the ship is returned to its standby-position on the tugboat 12, after which the electromagnet device 22 is lowered onto the deck 17 by means of the chain block.

As is apparent from the foregoing description, the device according to the present invention eliminates the fastening operation of the tug rope to the ship to be tugged, and hence the operators required for such operations. This in turn reduces the working hours required for securing the end of the tug rope to a ship, and yet the end of the tug rope may be secured to any position of the hull of the ship in a simple, fast, safe and positive manner.

In addition, according to the device of the present invention, even in case the difference in level of the tugboat and the ship to be tugged is considerably large, the elevation of the tug rope running from the tugboat to the ship being tugged is maintained constant and may be minimized, so that the thrust of the tugboat may be utilized for tugging the ship without an appreciable loss of power.

What is claimed is:

1. A device for connecting a tugboat with a ship to be tugged thereby, comprising:

a tug rope which may be paid out from said tugboat, and one end of which is secured to an anchor means mounted on said tugboat;

an electromagnet adapted to secure one end of said tug rope to the hull of said ship and to which is secured the other end of said tug rope; said electromagnet including a casing having a beam member therein, a plurality of magnetic pole members each having a pair of opposing yokes and disposed in two rows in side-by-side relation within said casing, a plurality of electric coils for exciting said magnetic pole members and surrounding all of said yokes of said magnetic pole members, and a plurality of spring assemblies affixing said magnetic pole members to said beam member within said casing; said spring assemblies each having a rod pivoted to said magnetic pole member at its one end, and at least one coil spring surrounding said rod and located on said beam member, and elastic deformation of said coil spring permitting the movement of each of said magnetic pole members.

2. A device for connecting a tugboat with a ship to be tugged thereby, comprising:

a tug rope, one end of which is secured to said tugboat;

an electromagnet, to which is secured the other end of said tug rope, said electromagnet being adapted to be drawn to the hull of said ship, when excited, said electromagnet including a plurality of magnetic pole members which are movable relative to each other; and means for supporting said electromagnet on said tugboat in a movable manner, and means for pushing said electromagnet, which is being supported on said tugboat, towards said ship to be tugged, said electromagnet supporting means including a frame consisting of a pair of posts pivoted to the deck of said tugboat and a tension rope, one end of which is secured to said deck, and supporting said posts in an inclined relation, and a chain block suspended from said frame and adapted to ascend and descend said electromagnet, and said electromagnet pushing means including a pair of power-driven pushing rods, which are engageable with said electromagnet which is supported by said frame in ascending and descending manner by the medium of said chain block.

* * * * *